US008548365B2

(12) United States Patent
Tomura et al.

(10) Patent No.: US 8,548,365 B2
(45) Date of Patent: Oct. 1, 2013

(54) IMAGE FORMING APPARATUS

(75) Inventors: Hisayuki Tomura, Izunokuni (JP); Takao Nada, Numazu (JP); Tomoya Tateishi, Suntou-gun (JP); Kenichi Iida, Tokyo (JP); Akimichi Suzuki, Yokohama (JP); Keisuke Mitsuhashi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 229 days.

(21) Appl. No.: 13/082,653

(22) Filed: Apr. 8, 2011

(65) Prior Publication Data

US 2011/0255909 A1 Oct. 20, 2011

(30) Foreign Application Priority Data

Apr. 14, 2010 (JP) ..... 2010-093349

(51) Int. Cl.
*G03G 15/01* (2006.01)

(52) U.S. Cl.
USPC ..... 399/302; 399/308; 399/388

(58) Field of Classification Search
USPC ..... 399/302, 308, 388
See application file for complete search history.

(56) References Cited

U.S. PATENT DOCUMENTS 6,516,179 B1 2/2003 Sawai et al.
6,947,695 B2 9/2005 Iida et al.
6,956,594 B2 10/2005 Iida et al.
7,043,183 B2 5/2006 Yoda et al.
2006/0024095 A1* 2/2006 Suzuki et al. ..... 399/307
2011/0194879 A1 8/2011 Nomura et al.

FOREIGN PATENT DOCUMENTS

JP 2001-356538 A 12/2001
JP 2003-195667 A 7/2003
JP 2006-330702 A 12/2006
JP 2010-2838 A 1/2010

* cited by examiner

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

The image forming apparatus includes an endless and movable transfer material bearing belt, a transfer member, an opposing member and a belt guide member, wherein a conveyance direction of the transfer material in a first area is substantially the same as a conveyance direction of the transfer material in a second area, the first area corresponding to a nip area formed by the opposing member and the transfer member and the second area corresponding to an area in which the belt guide member bringing the transfer material bearing belt and the image bearing belt come into contact with each other. By the virtue of the present invention, a transfer material is restrained from scraping off the leading end of a toner image before the leading end of the toner image enters a transfer nip portion, while suppressing spattering of the toner image on the upstream of the transfer nip portion.

11 Claims, 13 Drawing Sheets

IMAGE FORMING APPARATUS

BACKGROUND OF THE INVENTION

1. Field of the Invention

The present invention relates to image forming apparatuses, such as copying machines and laser printers, that adopt an intermediate transfer system of an electrophotographic system or an electrostatic recording system for transferring a toner image formed on an image bearing member onto an intermediate transfer member and thereafter transferring the toner image onto a transfer material.

2. Description of the Related Art

A configuration is conventionally known which transfers a toner image from a movable image bearing belt bearing the toner image, to a transfer material in a transfer nip portion.

Japanese Patent Application Laid-Open Nos. 2001-356538 and 2006-330702 disclose image forming apparatuses including a guide member provided upstream of the transfer nip portion in order to guide the conveyance direction of the transfer material until the transfer material reaches the transfer nip portion.

Japanese Patent Application Laid-Open No. 2001-356538 discloses a configuration of the guide member in which the guide member guides the transfer material to the transfer nip portion, brings the leading end of the transfer material into contact, first, with the image bearing belt, and in this state, guides the transfer material to the transfer nip portion. However, in this configuration, the leading end of the transfer material may scrape off the toner image borne on the intermediate transfer belt. For with-margin printing, the leading end of the transfer material enters the transfer nip portion before the leading end of the toner image. Thus, the leading end of the transfer material is unlikely to scrape off the toner image. However, even in the with-margin printing, when the leading end of the transfer material is close to the leading end of the toner image (the marginal portion is small), the leading end of the transfer material may scrape off the toner image if a position where the transfer material comes into contact with the image bearer is displaced.

Moreover, in marginless printing in which the toner image is formed all over the transfer material including the edges thereof, the leading end of the toner image enters the transfer nip portion before the leading end of the transfer material. Thus, the leading end of the transfer material is likely to scrape off the toner image.

Furthermore, Japanese Patent Application Laid-Open No. 2006-330702 discloses a configuration in which the leading end of the transfer material is brought into abutting contact, first, with a secondary transfer roller to guide the transfer material P along the surface of the secondary transfer roller 100 to a pre-transfer nip portion. However, in Japanese Patent Application Laid-Open No. 2006-330702, in the conveyance direction of the transfer material, the secondary transfer roller 100 is arranged upstream of an opposing roller opposite which the secondary transfer roller lies via an image bearing belt. Thus, the image bearing belt is bent immediately before the transfer nip portion formed by the opposing roller and the secondary transfer belt via the image bearing belt. The bent portion may make the conveyance of the transfer material unstable. Furthermore, immediately before the transfer nip portion, the toner image and the transfer material lie opposite each other via a very small gap. Hence, electric discharge may occur at the gap. This electric discharge disadvantageously causes the toner image to be spattered immediately before the transfer nip portion.

SUMMARY OF THE INVENTION

A purpose of the present invention is to provide an image forming apparatus which restrains a transfer material from scraping off the leading end of a toner image before the leading end of the toner image enters a transfer nip portion, while suppressing spattering of the toner image on the upstream side of the transfer nip portion. Another purpose of the present invention is to provide an image forming apparatus, including an endless and movable image bearing belt that bears a toner image, an endless and movable transfer material bearing belt that bears and conveys transfer material, a first tension member configured to supply a tension to the transfer material bearing belt member, a second tension member configured to supply a tension to the transfer material bearing belt member, wherein the second tension member is arranged downstream of the first tension member in a moving direction of the transfer material bearing belt, a transfer member arranged on an inner surface side of the transfer material bearing belt between the first tension member and the second tension member to transfer the toner image from the image bearing belt to the transfer material borne on the transfer material bearing belt, an opposing member configured to supply a tension to the image bearing belt, the opposing member nipping the image bearing belt and the transfer material bearing belt together with the transfer member; and a belt guide member arranged on an inner surface side of the transfer material bearing belt between the first tension member and the transfer member to guide movement of the transfer member bearing belt. A conveyance direction of the transfer material in a first area is substantially the same as a conveyance direction of the transfer material in a second area, the first area corresponding to a nip area formed by the opposing member and the transfer member and the second area corresponding to an area in which the belt guide member bringing the transfer material bearing belt and the image bearing belt come into contact with each other.

A still further feature of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Exemplary embodiments of the present invention will be described below in detail in an illustrative manner with reference to the drawings. However, the size, material, shape, and relative arrangement of components described in the following exemplary embodiments need to be appropriately changed depending on the configuration of an apparatus to which the present invention is applied and various conditions. Thus, the scope of the present invention is not intended to be limited to the configuration and the various conditions unless otherwise specified.

Exemplary Embodiment 1

Figure 1:
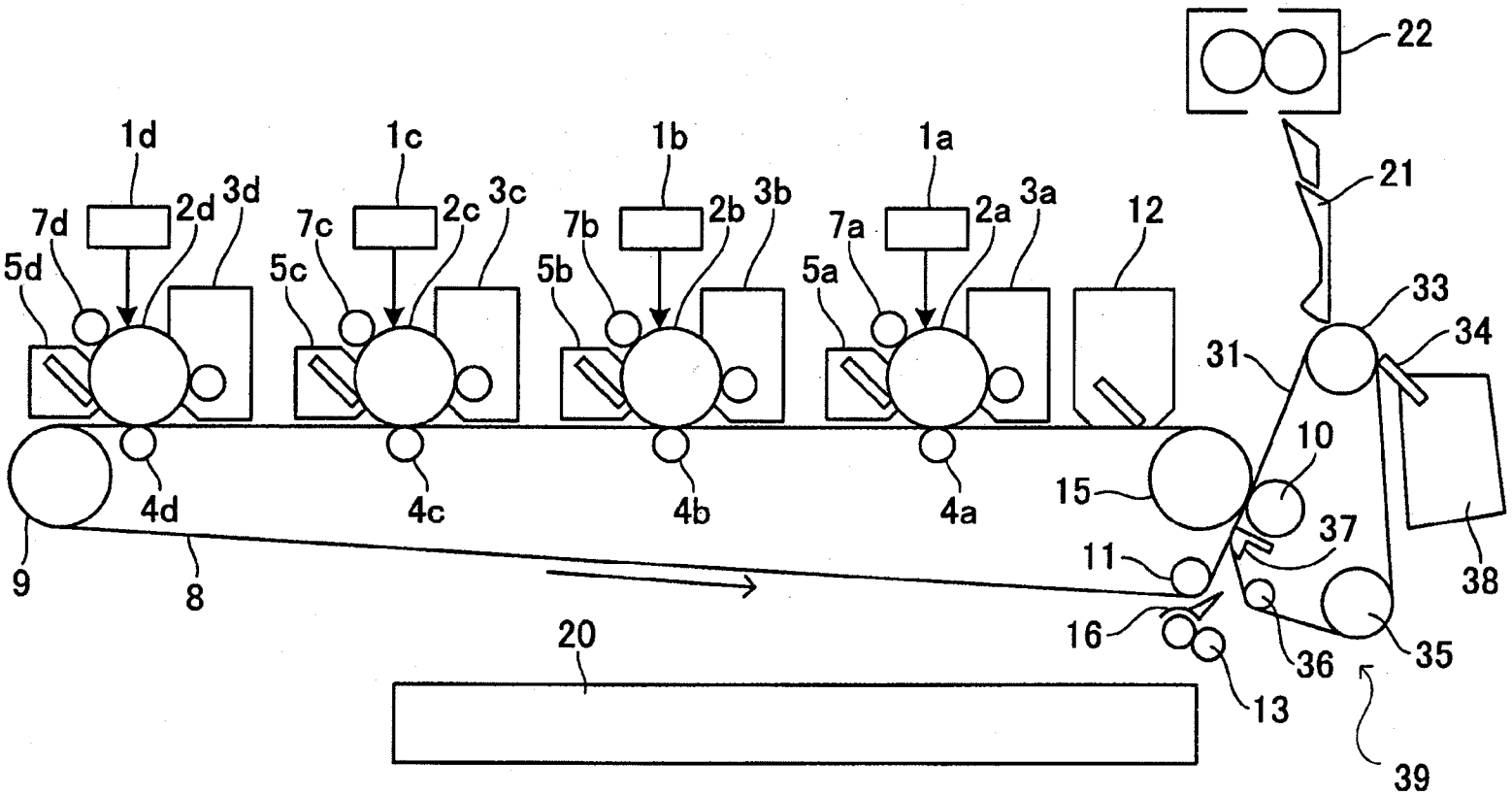
FIG. 1 schematically illustrates the configuration of an image forming apparatus according to the present invention.

With reference to FIG. 1, the general configuration of an image forming apparatus according to the present exemplary embodiment will be described. The image forming apparatus according to the present exemplary embodiment is an electrophotographic color laser printer adopting an intermediate transfer scheme. Specifically, an inline intermediate transfer scheme is adopted in which image bearers provided for respective toner colors are arranged in line with respect to an intermediate transfer belt. Furthermore, a marginless print mode can be carried out in which an image larger than a transfer material in size is formed on the image bearer and in which the image is transferred onto the transfer material via an intermediate transfer belt that is an image bearing belt to obtain a marginless image with no margin on the transfer material. Here, the marginless print mode refers to a mode allowing formation of an image with no margin on at least one side of the transfer material.

The image forming apparatus includes a plurality of photosensitive drums 2 (2*a*, 2*b*, 2*c*, and 2*d*) provided for the respective toner colors (yellow, magenta, cyan, and black). A charging roller (7*a*, 7*b*, 7*c*, and 7*d*), an exposure unit (1*a*, 1*b*, 1*c*, and 1*d*), a developing device (3*a*, 3*b*, 3*c*, and 3*d*), and a cleaning device (5*a*, 5*b*, 5*c*, and 5*d*) are provided around each of the photosensitive drums 2. Furthermore, a transfer roller (4*a*, 4*b*, 4*c*, and 4*d*) is provided at a position where the transfer roller 4 is opposite each of the photosensitive drums (2*a*, 2*b*, 2*c*, and 2*d*). The photosensitive drum (2*a*, 2*b*, 2*c*, and 2*d*) and the transfer roller (4*a*, 4*b*, 4*c*, and 4*d*) are in pressed contact with each other to form a primary transfer nip portion.

Furthermore, the image forming apparatus according to the present exemplary embodiment includes an endless intermediate transfer belt 8 (image bearing belt) sandwiched between the photosensitive drum (2*a*, 2*b*, 2*c*, and 2*d*) and the transfer roller (4*a*, 4*b*, 4*c*, and 4*d*) and which is movable in the direction of an arrow in FIG. 1. The intermediate transfer belt 8 is an endless single-layer resin belt and is formed of polyimide with the resistance thereof adjusted by dispersing carbon therein.

A tension roller 9, a tensioning roller 11, and an opposing roller 15 are provided on the inner surface side of the intermediate transfer belt 8 as tension members. These rollers contact the inner surface side of the intermediate transfer belt 8 to put the intermediate transfer belt 8 to tension in a movable manner. The tension roller 9 is a hollow aluminum tube and is subjected to a bias force by a spring in a bearing (not shown in the drawings) at each of the opposite ends of the tension roller 9 in the axial direction thereof. Thus, a constant tension is applied to the intermediate transfer belt 8. The tensioning roller 11 is formed of stainless steel and rotates under a frictional force exerted by the inner surface side of the intermediate transfer belt 8. The opposing roller 15 includes a metal core and EPDM rubber coated around the metal core and adjusted in resistance by carbon black. The opposing roller 15 is an opposing member located opposite a secondary transfer roller 10 described below with the intermediate transfer belt 8 sandwiched between the opposing roller 15 and the secondary transfer roller 10; the secondary transfer roller 10 serves as a transfer member. Furthermore, the core metal of the opposing roller 15 is grounded.

When an image forming process is carried out in the configuration described above, first, the exposure unit (1*a*, 1*b*, 1*c*, 1*d*) emits laser light based on input image information. Thus, the surface of the photosensitive drum (2*a*, 2*b*, 2*c*, 2*d*) is exposed for scanning; the surface has been uniformly charged to the same polarity as that of toner by a superimposed voltage (AC+DC) applied by the charging roller (7*a*, 7*b*, 7*c*, 7*d*). Hence, an electrostatic latent image is formed on a portion of the photosensitive drum (2*a*, 2*b*, 2*c*, 2*d*) which has been exposed for scanning. The exposure unit (1*a*, 1*b*, 1*c*, 1*d*) includes a near infrared laser diode (not shown in the drawings) and a polygon scanner which scans laser light.

Then, the developing device (3*a*, 3*b*, 3*c*, 3*d*), in which toner is accommodated, supplies the toner to the electrostatic latent image. The developing device (3*a*, 3*b*, 3*c*, 3*d*) includes a developing roller which bears the toner. The toner is electrostatically fed from the developing roller to the electrostatic latent image to develop the electrostatic latent image into a toner image. Nonmagnetic monocomponent toner is used for the developing device (3*a*, 3*b*, 3*c*, 3*d*) according to the present exemplary embodiment as a developer. A contact development scheme in which the developing roller contacts the surface of the photosensitive drum (2*a*, 2*b*, 2*c*, 2*d*) is adopted for the developing device (3*a*, 3*b*, 3*c*, 3*d*) according to the present exemplary embodiment.

The toner image developed on the surface of the photosensitive drum (2*a*, 2*b*, 2*c*, 2*d*) is conveyed to a primary transfer nip portion in conjunction with rotation of the photosensitive drum (2*a*, 2*b*, 2*c*, 2*d*). The transfer roller (4*a*, 4*b*, 4*c*, 4*d*) is connected to a voltage application part (not shown in the drawings). The voltage application part applies a primary transfer voltage to the transfer roller (4*a*, 4*b*, 4*c*, 4*d*) to allow the toner image to be primarily transferred from the surface of the photosensitive drum (2*a*, 2*b*, 2*c*, 2*d*) to the surface of the intermediate transfer belt 8. Residual toner remaining on the surface of the photosensitive drum (2*a*, 2*b*, 2*c*, 2*d*) after the primary transfer is removed by a blade member provided in the cleaning device (5*a*, 5*b*, 5*c*, 5*d*).

The above-described process allows single-color toner images to be sequentially transferred to the surface of the intermediate transfer belt 8. Thus, a toner image T1 in a desired tone can be obtained on the surface of the intermediate transfer belt 8 by superimposing the single-color toner images on one another on the surface of the intermediate transfer belt 8. The toner image T1 thus formed on the surface of the intermediate transfer belt 8 is conveyed to a secondary transfer nip portion in conjunction with movement of the intermediate transfer belt 8. In the secondary transfer nip portion, the toner image T1 is transferred to a transfer material P. The secondary transfer nip portion is a first area formed by bringing the opposing roller 15 and the secondary transfer roller 10 into pressed contact with each other via the intermediate transfer belt and a secondary transfer belt described below.

On the other hand, a feeding section 20 in which a plurality of transfer materials P is accommodated is provided below the image forming apparatus. When the image forming process is started, one of the transfer materials P is fed from the feeding section 20 through a conveyance unit such as a feeding roller and a conveyance roller. Subsequently, a before-transfer conveyance roller 13 adjusts a timing for the transfer material P such that while guided by the before-transfer guide 16, the transfer material P is conveyed to a secondary transfer unit 39 described below and then to the secondary transfer nip portion.

In the secondary transfer nip portion, the toner image T1 is secondarily transferred to the transfer material P. The transfer material P is then guided by a conveyance guide 21 and conveyed to a fixing device 22. In the fixing device 22, the toner image is fixed on the transfer material P under heat and pressure. Toner failing to be secondarily transferred and remaining on the intermediate transfer belt 8 is removed by the blade member provided in the belt cleaning device 12. The transfer material P with the toner image thus fixed thereon is discharged to the outside of the image forming apparatus.

An image forming apparatus using the intermediate transfer scheme as in the present embodiment can increase the speed of the image forming process. Furthermore, toner images from the photosensitive drums 2 are superimposed on one another on the same object (intermediate transfer belt 8). Thus, the toner images can be superimposed on one another stably and accurately in position.

Figure 2:
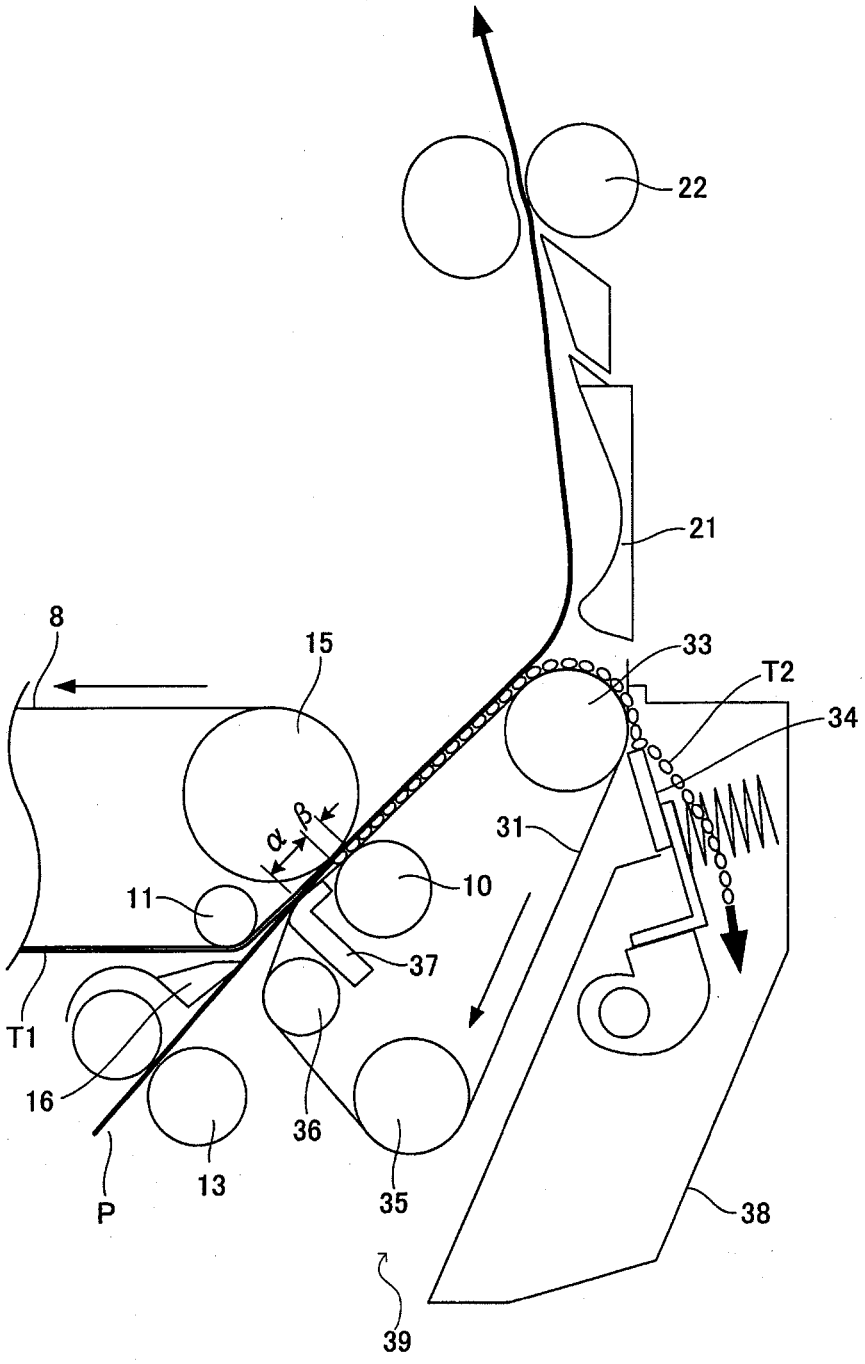
FIG. 2 schematically illustrates the configuration of a secondary transfer unit according to Exemplary Embodiment 1.
Figure 3:
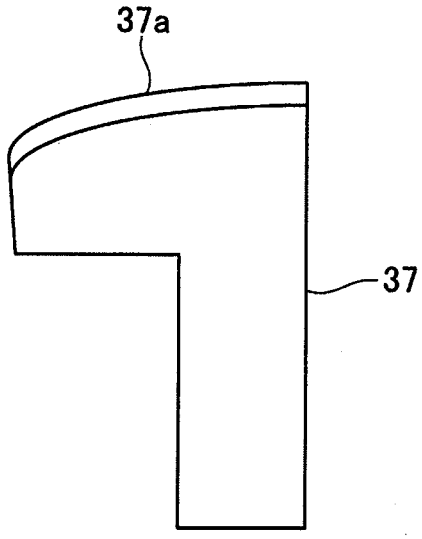
FIG. 3 schematically illustrates the configuration of a belt guide member according to Exemplary Embodiment 1.

The general configuration of the secondary transfer unit 39 according to the present exemplary embodiment will be described with reference to FIG. 2 and FIG. 3. FIG. 2 is a diagram schematically showing the secondary transfer unit 39 according to the present exemplary embodiment. FIG. 3 is a diagram schematically showing a belt guide member 37 according to the present exemplary embodiment.

As illustrated in FIG. 2, the secondary transfer unit 39 includes a secondary transfer belt 31, a secondary transfer roller 10, a secondary transfer belt driving roller 33, a cleaning blade 34, a secondary transfer tension roller 35, an idle roller 36, and the belt guide member 37. The secondary transfer belt 31 bears the conveyed transfer material P and is provided to serve as a transfer material bearing belt. The secondary transfer roller 10 is a transfer member which forms electric fields used to transfer toner images. The secondary transfer belt driving roller 33, the secondary transfer tension roller 35, and the idle roller 36 are tension members on which the secondary transfer belt 31 is put to tension. The secondary transfer belt 31, serving as a transfer material bearing belt, is a single-layer, endless (seamless) resin belt. The secondary transfer belt 31 is adjusted in resistance by dispersing carbon in a polyimide material, which is the main material of the belt. The secondary transfer belt 31 according to the present exemplary embodiment includes a surface with an excellent slipping property. Thus, the toner adhering to the secondary transfer belt 31 can be easily removed by a cleaning blade 34 described below. Furthermore, the transfer material P can slide on the secondary transfer belt 31 under reduced friction. This will be described below in detail.

The secondary transfer belt driving roller 33 puts the secondary transfer belt 31 to tension to drive the secondary transfer belt 31. The secondary transfer belt driving roller 33 is formed by coating a core metal with EPDM rubber adjusted in resistance by carbon black.

The secondary transfer tension roller 35 is a hollow aluminum tube and is subjected to a bias force by a spring in a bearing at each of the opposite ends of the secondary transfer tension roller 35 in the axial direction thereof; the bias force acts toward the back surface of the secondary transfer belt 31. The secondary transfer tension roller 35 puts the secondary transfer belt 31 to tension.

The idle roller 36 is formed of stainless steel to put the secondary transfer belt 31 to tension. The idle roller 36 rotates in conjunction with the secondary transfer belt 31. Here, the idle roller 36 is a first tension member on which the secondary transfer belt 31, serving as a transfer material bearing belt, is put to tension. The secondary transfer belt driving roller 33, arranged downstream of the first tension member in the moving direction of the belt, is a second tension member.

The secondary transfer roller 10 is formed by coating an elastic layer formed of foamed hydrin rubber on a core metal connected to the voltage application part (not shown in the drawings) via an electric feeding spring. The secondary transfer roller 10 is in pressed contact with the opposing roller 15 with the intermediate transfer belt 8 and the secondary transfer belt 31 sandwiched between the secondary transfer roller 10 and the opposing roller 15. Thus, a first area β is formed between the secondary transfer roller 10 and the opposing roller 15; the first area β is a secondary transfer nip portion and has a predetermined width in the conveyance direction of the transfer material P. Furthermore, in the present exemplary embodiment, toner is prevented from being in direct contact with the secondary transfer roller 10, thus avoiding restricting the physical properties of the roller other than the resistance and hardness thereof. Hence, rubber materials such as EPDM, urethane, NBR, epichlorohydrin, and silicon may be used as a raw material for the secondary transfer roller 10.

The belt guide member 37 is fixedly arranged on the inner surface side of the secondary transfer belt 31 to press the inner surface side of the secondary transfer belt 31 to allow a pressed portion of the secondary transfer belt 31 to protrude toward the intermediate transfer belt 8, thus bringing the secondary transfer belt 31 and the intermediate transfer belt 8 into tight contact with each other. The belt guide member 37 is provided downstream of the tensioning roller 11 and upstream of the opposing roller 15 in the moving direction of the intermediate transfer belt 8 at a position where the secondary transfer belt 31 is tightly contacted with the intermediate transfer belt 8. In the moving direction of the secondary transfer belt 31, the belt guide member 37 is provided between the idle roller 36, serving as the first tension member, and the secondary transfer roller 10, serving as the transfer member.

FIG. 3 schematically illustrates the configuration of the belt guide member 37. As illustrated in FIG. 3, the belt guide member 37 according to the present exemplary embodiment includes a front surface 37*a* coated with a fluorinated compound. The front surface 37*a* is in contact with the back surface of the secondary transfer belt 31. The front surface 37*a* is in contact with the entire area of the secondary transfer belt 31 in the width direction thereof. Furthermore, the belt guide member 37 is formed of a hard resin so as not to be flexed by the tensioning force of the secondary transfer belt 31.

The present exemplary embodiment uses the belt guide member 37 with the front surface 37*a* coated with the fluorinated compound. However, the belt guide member 37 may be wholly formed of a fluoride resin. Alternatively, a polymer polyethylene sheet may be stuck to the belt guide member 37 and contacted with the inner surface side of the secondary transfer belt 31. One of the front surface 37*a* and belt guide member 37 thus formed of the low-friction member allows the sliding property between the belt guide member 37 and the inner surface side of the secondary transfer belt 31 to be improved and enables the secondary transfer belt 31 to be restrained from being worn over time.

The cleaning blade 34 is a transfer member cleaning unit which removes toner T2 adhering to the secondary transfer belt 31. The cleaning blade 34 is formed of urethane rubber and is in contact, at the leading end thereof, with the secondary transfer belt 31 on the secondary transfer belt driving roller 33. Furthermore, the toner T2 scraped off by the cleaning blade 34 is accommodated in a waste toner container 38.

As illustrated in FIG. 2, a second area α and the first area β are formed between the intermediate transfer belt 8 and the secondary transfer belt 31 in this order from the upstream side in the moving direction of both belts. These areas are formed as follows.

The "second area α" is an area formed by the action of the belt guide member 37 and in which the secondary transfer belt 31 and the intermediate transfer belt 8 are in contact with each other. The belt guide member 37 protrudes toward the intermediate transfer belt 8 by a predetermined protrusion amount to form the second area α. The conveyed transfer material P is sandwiched, in the second area α, between the intermediate transfer belt 8 and the secondary transfer belt 31 and then conveyed to the secondary transfer nip portion. The first area β is formed by bringing the secondary transfer roller 10 and the opposing roller 15 into pressed contact with each other via the two belts. The first area β corresponds to the above-described secondary transfer nip portion. As described above, the secondary transfer roller 10 is connected to the voltage application part. The opposing roller 15 is grounded. A transfer voltage is applied to the secondary transfer roller 10 to form a transfer electric field in the first area β.

Hence, when the transfer material P conveyed from the second area a enters the first area β, the toner image T1 borne on the intermediate transfer belt 8 in the first area β is secondarily transferred onto the transfer material P in an electrostatic manner. The second area α and first area β as described herein are consecutive in the conveyance direction of the transfer material.

A conveyance path for the transfer material P in the secondary transfer unit 39 will be described. A timing for the transfer material P conveyed by the feeding section 20 is adjusted by the before-transfer conveyance roller 13. Moreover, while guided by the before-transfer guide 16, the transfer material P is brought into contact, first, with the secondary transfer belt 31 at the leading end of the transfer material P in the conveyance direction thereof. In the present exemplary embodiment, the leading end of the transfer material P contacts the vicinity of the belt guide member 37 on the surface of the secondary transfer belt 31.

The secondary transfer belt 31 has such an excellent slipping property that the transfer material P in contact with the belt guide member 37 at the leading end of the transfer material P is subsequently guided toward the second area α while sliding on the surface of the secondary transfer belt 31. In this case, the belt guide member 37, which is rigid, is provided at an entry point where the transfer material P enters the second area α. Thus, even if the transfer material P has a great basis weight, the transfer material P can be reliably guided to the second area α.

As described above, in the present exemplary embodiment, the leading end of the conveyed transfer material P is brought into contact, first, with the secondary transfer belt 31. In this state, the transfer material P is conveyed to the second area α and to the first area β. This configuration allows the leading end of the transfer material P in the conveyance direction to be restrained from scraping off the toner image borne on the intermediate transfer belt 8. This also enables a reduction in the amount of toner adhering to an edge portion of the transfer material P at the leading end thereof.

Now, a mechanism for restraining the leading end of the transfer material P in the conveyance direction from scraping off the toner image borne on the intermediate transfer belt 8 will be described below in detail.

Figure 4:
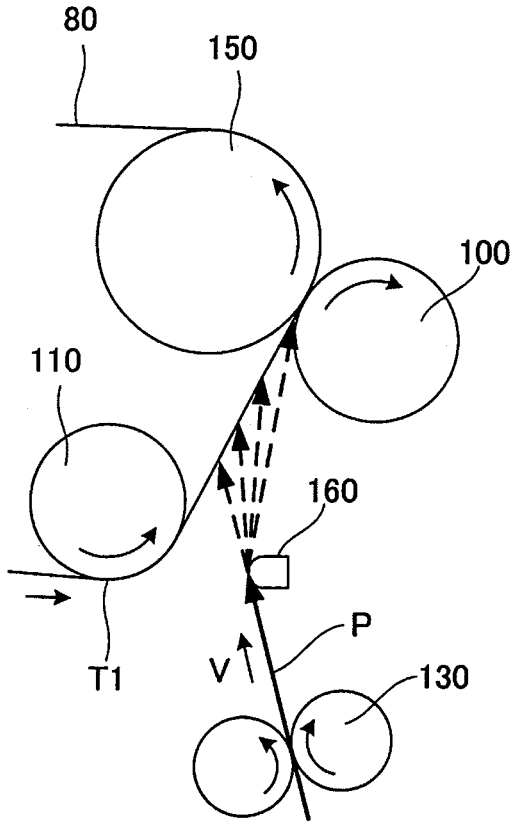
FIG. 4 illustrates a mechanism in which the leading end of a transfer material contacts a toner image on an image bearing belt.

The problem in which the leading end of the transfer material in the conveyance direction scrapes off the toner image borne on the intermediate transfer belt is likely to occur particularly when a marginless print mode is selected. Assuming an image forming apparatus in which the leading end of the transfer material P as illustrated in FIG. 4 comes into contact, first, with an intermediate transfer belt 80, a mechanism will be described in which a toner image borne on the intermediate transfer belt is scraped off by the leading end of the transfer material. In particular, in the marginless print mode, a toner image larger than the transfer material P in size is formed on the intermediate transfer belt 80. Thus, in most cases, the leading end of the transfer material P contacts the toner image T1 on the intermediate transfer belt 80. When the leading end of the transfer material comes into contact with the intermediate transfer belt 80, the transfer material P is changed in posture taking a before-transfer guide 160 as a fulcrum as illustrated by a dotted line in FIG. 4, as the intermediate transfer belt 80 moves. FIG. 4 illustrates a secondary transfer roller 100, a tensioning roller 110, a before-transfer conveyance roller 130, and an opposing roller 150.

Figure 5:
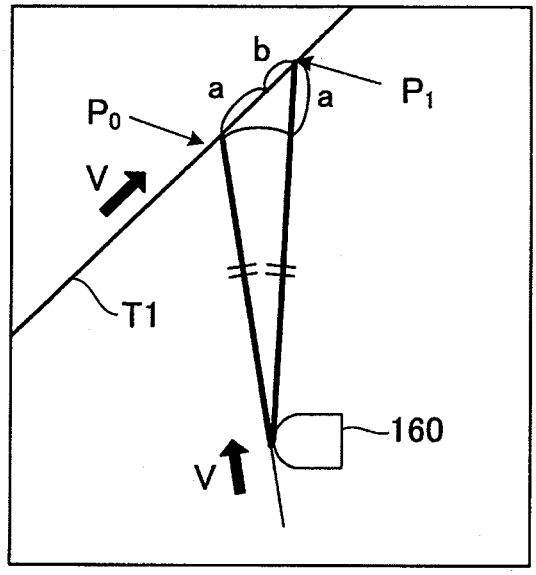
FIG. 5 illustrates a mechanism in which the leading end of the transfer material scrapes off the toner image on the image bearing belt.

FIG. 5 is an enlarged diagram of a variation in the posture of the transfer material P illustrated in FIG. 4. $P_0$ in FIG. 5 corresponds to the point of contact of the leading end of the transfer material P in the conveyance direction observed before the posture of the transfer material P changes. $P_1$ in FIG. 5 corresponds to the point of contact of the leading end of the transfer material P in the conveyance direction observed when the posture of the transfer material P changes. The transfer material P is conveyed by the before-transfer conveyance roller 130. When the leading end of the transfer material P in the conveyance direction reaches the $P_1$ after entering the $P_0$, the transfer material P has been conveyed a distance (a). At this time, to allow the intermediate transfer belt 8 to move from the $P_0$ to the $P_1$ integrally with the leading end of the transfer material P in the conveyance direction, the intermediate transfer belt 8 needs to move a distance a+b. However, the transfer material P and the intermediate transfer belt 8 are conveyed at an equal speed V, and thus the intermediate transfer belt 8 actually advances the distance (a). Hence, the transfer material P moves further than the intermediate transfer belt 8 by a distance (b). As a result, the leading end of the transfer material P in the conveyance direction rubs against and scrapes off the toner image borne on the intermediate transfer belt 8.

In contrast, the image forming apparatus according to the present exemplary embodiment, as illustrated in FIG. 2, the leading end, in the conveyance direction, of the transfer material P conveyed on the secondary transfer belt 31 in a sliding manner is introduced into the second area α. At this time, the transfer material is borne on the secondary transfer belt and thus prevented from coming into contact with the intermediate transfer belt 8 before reaching the second area α. Since the intermediate transfer belt 8, the transfer material P, and the secondary transfer belt 31 are further integrally conveyed at the equal speed, the leading end of the transfer material P in the conveyance direction can be restrained from scraping off the toner image on the intermediate transfer belt 8.

Moreover, in the image forming apparatus according to the present exemplary embodiment, the conveyance direction of the transfer material P in the second area α is substantially the same as that in the first area β.

Figure 6:
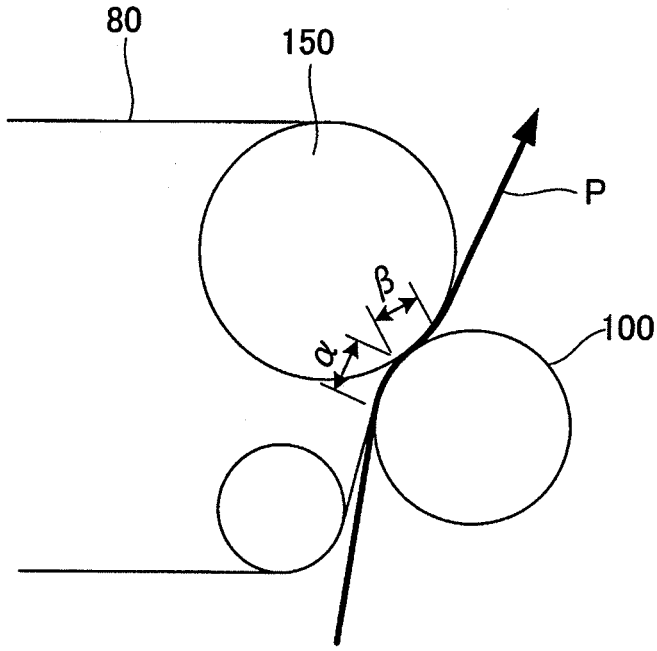
FIG. 6 illustrates how the transfer material is bent.

The effects of this configuration will be described with reference to a comparative configuration illustrated in FIG. 6. FIG. 6 illustrates the configuration in which the leading end of the transfer material P is brought into abutting contact, first, with the secondary transfer roller 100 and in which the transfer material P is then guided to the immediately-before-transfer nip portion α along the surface of the secondary transfer roller 100. In the configuration, the secondary transfer roller 100 is arranged upstream of the opposing roller 150 in the conveyance direction of the transfer material P. Thus, the pre-transfer nip portion α and the transfer nip portion β are consecutively arranged in a bent manner (the conveyance direction of the transfer material is not the same between the pre-transfer nip portion α and the transfer nip portion β).

Figure 7:
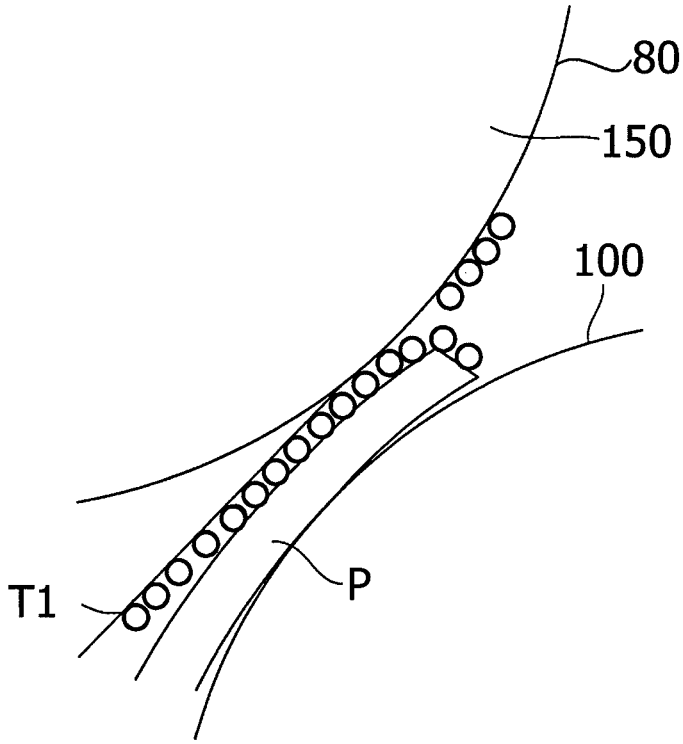
FIG. 7 illustrates how the leading end of the transfer material scrapes off the toner image on the image bearing belt.

In this case, as illustrated in FIG. 7, the toner image T1 on the intermediate transfer belt 80 is likely to be scraped off by the edge portion of the transfer material P at the leading end thereof. This is expected to be because the transfer material is bent during conveyance and thus pushed in toward the downstream side in the conveyance direction owing to the rigidity of the transfer material.

Figure 8A:
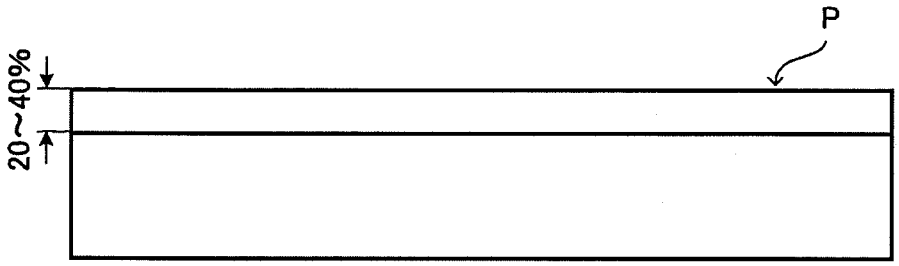
FIGS. 8A and 8B illustrate a toner adhesion area in a leading end edge portion of the transfer material in the conveyance direction.
Figure 8B:
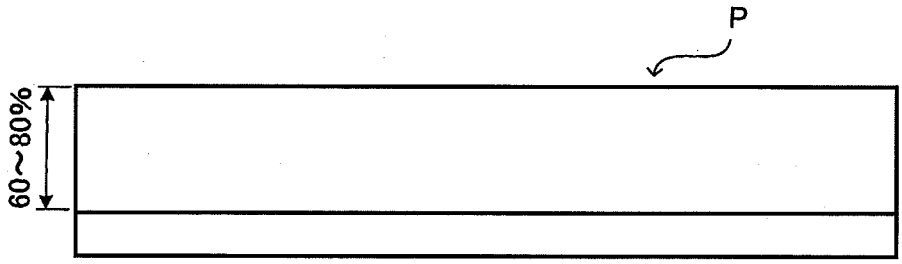

However, in the present exemplary embodiment, the conveyance direction of the transfer material P in the second area α is almost the same as that in the first area β. Thus, the leading end of the transfer material is prevented from being pushed in toward the downstream side in the conveyance direction. As a result, the toner image is unlikely to be scraped off by the leading end of the transfer material P in the conveyance direction. FIG. 8A illustrates a toner adhesion area in the edge portion of the transfer material P at the leading end thereof in the conveyance direction which area results from formation of an image on the transfer material P using the configuration according to the present exemplary embodiment. Compared to FIG. 8B illustrating the results for the configuration in FIG. 6, FIG. 8A indicates that the image forming apparatus according to the present exemplary embodiment enables a sharp reduction in the amount of toner adhering to the edge portion of the transfer material at the leading end thereof in the conveyance direction.

Furthermore, when the leading end of the transfer material P is introduced into the secondary transfer nip portion without sufficiently tight contact between the transfer material P and the intermediate transfer belt as illustrated in FIG. 6, a transfer electric field is generated between the transfer material P and the intermediate transfer belt in a condition where there is a gap between the transfer material P and the intermediate transfer belt. On the other hand, the toner acts to migrate from the intermediate transfer belt to the transfer material P under a force exerted by the transfer electric field. However, since there is a gap between the intermediate transfer belt and the transfer material P, the toner flies between the intermediate transfer belt and the transfer material P, that is, the toner moves through the gap that is a long distance for the toner. As a result, the toner moves unstably.

Additionally, the toner has given amount of charge, and particles of toner tend to repel each other in an electrostatic manner. Hence, the presence of the gap causes "spattering of toner", a phenomenon in which the area of the transfer material P onto which the toner adheres expands during a transfer process.

In addition, when the transfer material P enters the transfer nip without sufficiently tight contact between the intermediate transfer belt and the transfer material P as illustrated in FIG. 6, a transfer electric field is generated in the gap. When the transfer electric field in the gap portion exceeds a value according to the Paschen's Law, electric discharge occurs in the gap portion. Particles of the toner located close to the gap may be reversed in polarity. For example, particles of the toner charged to a negative polarity are reversed in polarity to have a positive polarity. Then, as a result of transfer steps, the toner particles with the reversed polarity travel in a direction opposite to the one in which the toner particles otherwise travel. The toner particles are thus prevented from reaching the transfer material P. Portions of the transfer material P which are not reached by the toner particles lack the toner image. That is, a "blank spots in transfer" occurs which causes a transfer defect.

In contrast, in the present exemplary embodiment, the transfer material P and the intermediate transfer belt 8 can be sufficiently contacted with each other in the "second area α". In this state, the transfer material P can be conveyed to the "first area β", that is, the secondary transfer nip portion. Hence, the above described "spattering of toner" and "blank spots in transfer" can be suppressed, enabling image quality to be improved.

Figure 9:
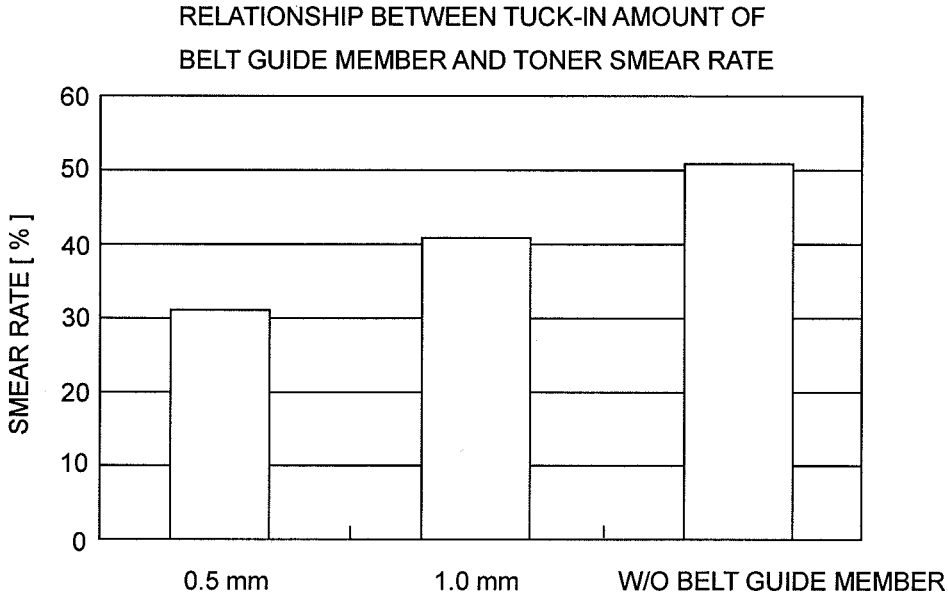
FIG. 9 illustrates the relationship between the amount of protrusion (mm) of the belt guide member and a toner soil ratio (%).

The amount by which the belt guide member 37 protrudes toward the intermediate transfer belt 8 according to the present exemplary embodiment will be described with reference to FIG. 9. FIG. 9 illustrates a variation in toner soil ratio (%) resulting from a variation in the amount of protrusion (mm) of the belt guide member 37. The amount of protrusion (mm) used herein refers to the amount by which the belt guide member 37 protrudes when the belt guide member 37 in contact with the inner surface side of the secondary transfer belt 31 (with the track of the secondary transfer belt 31 unchanged) is pushed toward the intermediate transfer belt 8. Furthermore, the toner soil ratio (%) refers to the ratio of the toner adhesion area to the entire edge area of the leading end edge of the transfer material P in the conveyance direction. If the belt guide member 37 protrudes toward the intermediate transfer belt 8 by 0.5 mm, the leading end edge portion of the transfer material P in the conveyance direction has a toner soil ratio of about 30%. In contrast, if the belt guide member 37 protrudes toward the intermediate transfer belt 8 by 1 mm, the leading end edge portion of the transfer material P in the conveyance direction has a toner soil ratio of about 40%. However, as seen in FIG. 9, indicating that the toner soil ratio is higher when the protrusion amount is 1.00 mm rather than when the protrusion amount is 0.5 mm, the toner soil ratio is also increased by an excessive amount of protrusion of the belt guide member 37. This is because excessive protrude of the belt guide member 37 toward the intermediate transfer belt 8 makes the conveyance direction of the transfer material P in the "second area α" differ from that in the "first area β", resulting in formation of a bent secondary transfer nip. That is, the amount of protrusion of the belt guide member 37 toward the intermediate transfer belt 8 can be greater than 0 mm and at most 1 mm.

Even if the belt guide member 37 is not provided (the amount of protrusion is 0 mm), the secondary transfer nip portion avoids forming a bent conveyance path in the present exemplary embodiment. Thus, the leading end of the transfer material P can be restrained from scraping off the toner image. In actuality, the edge portion of the transfer material P at the leading end thereof in the conveyance direction has been determined to have a toner soil ratio of about 50%, which is lower than the corresponding conventional value.

However, in this case, the transfer material P is introduced into the secondary transfer nip portion without sufficiently tight contact between the leading end of the transfer material P in the conveyance direction and the intermediate transfer belt 8. Hence, the "spattering of toner" may occur and the "blank spots in transfer" may result from electric discharge.

As illustrated in FIG. 3, the belt guide member 37 used in the present exemplary embodiment is shaped like a block formed only partly of a curved surface. The curved surface portion of the belt guide member 37 is contacted with the inner surface side of the secondary transfer belt 31 to allow the belt guide member 37 and the secondary transfer belt 31 to slide smoothly with respect to each other, with the moving direction of the secondary transfer belt 31 guided. Furthermore, provision of the belt guide member 37 makes the conveyance direction of the transfer material P almost the same in both the "second area α" and the "first area β".

Figure 10:
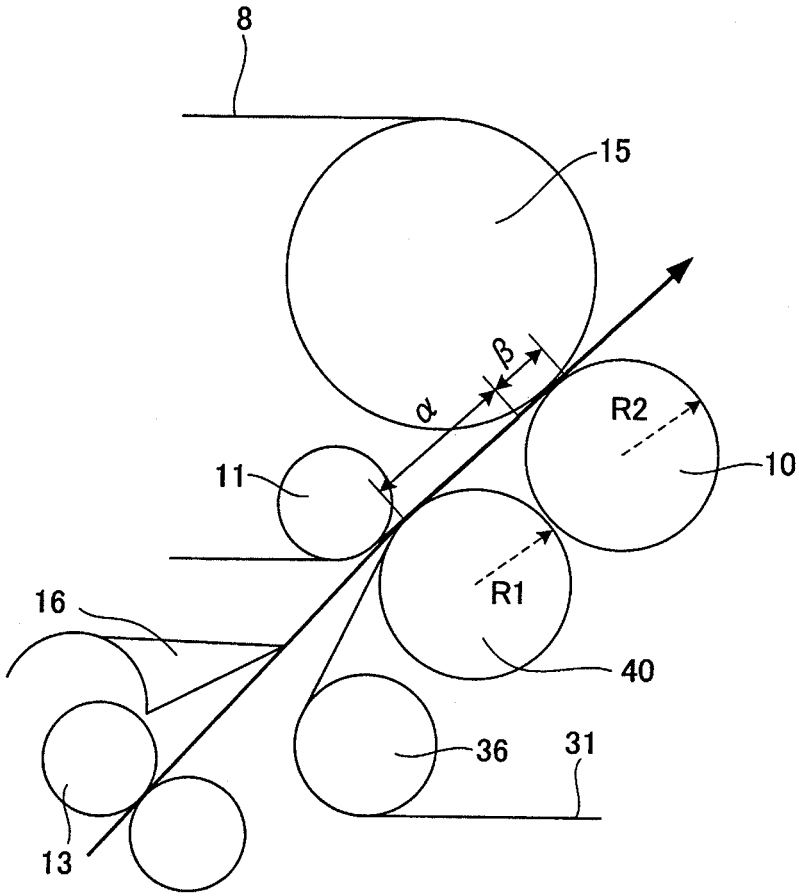
FIG. 10 schematically illustrates the configuration of a secondary transfer unit with a belt guide roller.

On the other hand, in connection with almost the same conveyance direction of the transfer material P in both the "second area α" and the "first area β", the belt guide member 37 may be shaped like a roller. FIG. 10 schematically illustrates the configuration of the secondary transfer unit 39 with a belt guide roller 40. Even if the belt guide roller 40 is provided as illustrated in FIG. 10, the conveyance direction of the transfer material is almost the same in both the "second area α" and the "first area β". However, in this case, the belt guide roller 40 needs to be grounded in order to prevent the "spattering of toner". Thus, the belt guide roller 40 needs to be arranged at a predetermined distance from the secondary transfer roller 10, to which the transfer voltage is applied. Hence, if the belt guide roller 40 is adopted, the relationship "second area α+first area β>R1+R2" is established. Then, the transfer material P starts to come into contact with the intermediate transfer belt 8 at a position upstream of and far away from the first area β where a transfer electric field is formed, in the moving direction of the secondary transfer belt 31. As a result, in a portion of the "second area α" located upstream of the transfer material P in the conveyance direction, the voltage applied to the secondary transfer roller 10 is unlikely to make one of the transfer material P and the intermediate transfer belt 8 charged. Even if one of the transfer material P and the intermediate transfer belt 8 is charged, the potential thereof is very low.

Thus, in the "second area α", particularly in the portion thereof located upstream of the transfer material P in the conveyance direction, the transfer material P and the intermediate transfer belt 8 are prevented from being strongly attracted to each other in an electrostatic manner so as to be in tight contact with each other. Thus, the transfer material P fails to follow recesses and protrusions on the surface of the intermediate transfer belt 8 and slack of the surface resulting from a slight curl thereon. As a result, the contact between the transfer material P and the intermediate transfer belt 8 is weakened. Furthermore, the weakened contact between the intermediate transfer belt 8 and the transfer material P may cause the transfer material P to be slightly displaced from the intermediate transfer belt 8 in the "second area α". This may disturb a part of the toner image present between the surface of the intermediate transfer belt 8 and the transfer material P. Thus, the toner image transferred onto the transfer material P having passed through the "first area β" may be subjected to the "blank spots in transfer", in which the toner image has a locally reduced density. Therefore, the image quality may be degraded.

In this connection, to solve the above-described problem resulting from the adoption of the belt guide roller 40, the diameter of the belt guide roller 40 may be minimized. However, when the belt guide roller 40 has an excessively small diameter, the secondary transfer belt 31 picks up the trait of being wound only in a particular manner. This may slightly vary the speed at which the transfer material P is conveyed by the secondary transfer belt 31. A variation in conveyance speed may lead to transfer unevenness in which the density of the toner image on the transfer material P varies in the conveyance direction.

Figure 11:
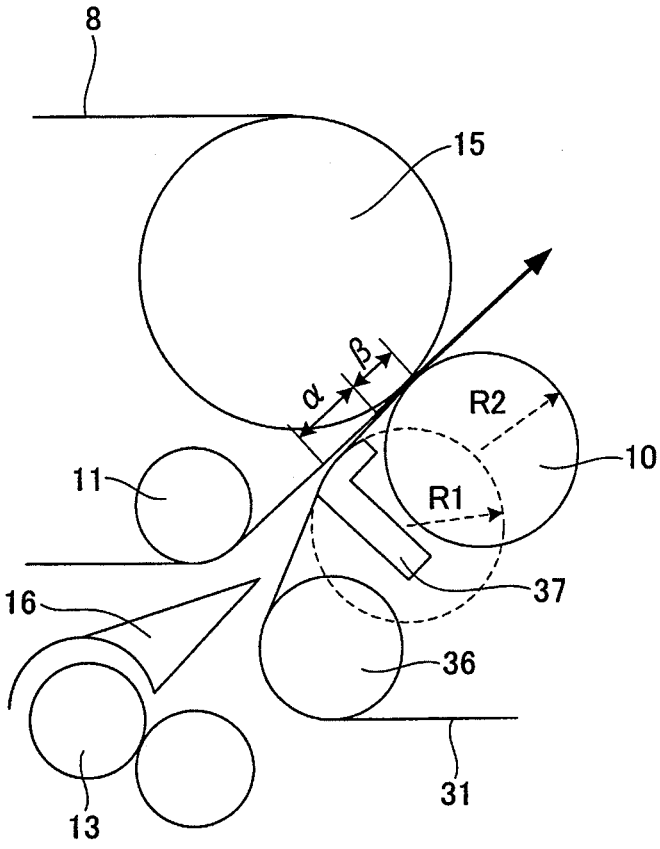
FIG. 11 schematically illustrates the configuration of the secondary transfer unit according to Exemplary Embodiment 1.

Thus, as illustrated in FIG. 11, the present exemplary embodiment uses the belt guide member 37 shaped like a block formed only partly of a curved surface. This allows the secondary transfer belt 31 to be guided by the curved surface, while enabling the entire "second area α" to approach the area (first area β) in which the transfer electric field is generated. That is, the relationship "second area α+first area β<R1+R2" is established, enabling the transfer material P to be reliably brought into tight contact with the intermediate transfer belt 8 in an electrostatic manner in almost the entire "second area α".

Moreover, unlike the belt guide roller 40, the belt guide member 37 according to the present exemplary embodiment can be substantially freely set in shape, size, or installation position. Furthermore, the radius of curvature of R1 of the belt guide member 37 can be increased. The radius of curvature R1 may be set to at least 5 mm. Furthermore, the radius of curvature R1 may be set to at least 10 mm. Setting the radius of curvature R1 to such a large value allows the secondary transfer belt 31, guided by the belt guide member 37 during movement, to be restrained from picking up the trait of being wound only in a particular manner. This allows suppression of transfer unevenness of the toner image associated with the trait, of the secondary transfer belt 31, of being wound only in a particular manner.

Furthermore, setting the radius of curvature of the belt guide member 37 to a larger value allows the transfer material P to be more smoothly introduced into the intermediate transfer belt 8. This serves to prevent an image shock problem that occurs when the transfer material P advances violently onto the intermediate transfer belt 8.

As described above, the front surface 37*a* of the belt guide member 37 is formed of the low-friction member. However, since the belt guide member 37 is fixedly arranged, contact with the belt guide member 37 serves to offer belt conveyance resistance while the secondary transfer belt 31 is moving. In this case, slight conveyance resistance acts on the belt guide member 37 to constantly generate tension in the belt guide member 37 in the "second area α" and "first area β" thereof. However, this configuration allows the following effect to be exerted. That is, the tension generated in the "second area α" and "first area β" of the secondary transfer belt 31 enables the belt to be restrained from being corrugated.

In the above description, the "spattering of toner" and the "blank spots in transfer" occur when the marginless print mode is carried out. However, even if the marginless print mode is not carried out, for example, even if the intervals between consecutive transfer materials are extremely short, the "spattering of toner" and the "blank spots in transfer" may occur.

Even in connection with these problems, the configuration according to the present exemplary embodiment enables the "spattering of toner" and the "blank spots in transfer" to be suppressed, for example, even if the intervals between consecutive transfer materials are extremely short.

Exemplary Embodiment 2

Figure 12:
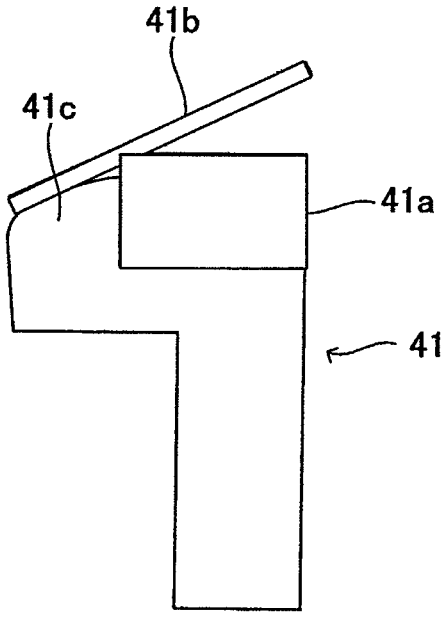
FIG. 12 schematically illustrates the configuration of a belt guide member according to Exemplary Embodiment 2.

With reference to FIG. 11 and FIG. 12, an image forming apparatus according to Exemplary Embodiment 2 will be described. The general configuration and the like of the image forming apparatus are the same as those in Exemplary Embodiment 1 except for the configuration of the belt guide member. Hence, the same components are denoted by the same reference numerals and will not be described below. Here, only the configuration of the belt guide member will be described.

FIG. 11 illustrates the general configuration of a belt guide member 41 according to the present exemplary embodiment. The belt guide member 41 includes an elastic layer 41*a* formed of an elastic body such as a foamed urethane rubber material and provided on a surface with a curved surface portion formed thereon. The elastic layer 41*a* is provided all over the belt guide member 41 in the width direction thereof (the direction from the reader to the back side of sheet of FIG. 11). The thickness of the elastic layer 41*a* is set to between 2.0 mm and 5.0 mm with balance with the hardness of the elastic layer 41*a* taken into account. The hardness is set to at most 60 degrees in terms of Asker C hardness.

The surface of the elastic layer 41*a* is covered with a polymer polyethylene sheet 41*b*. One end (fixed end) of the polymer polyethylene sheet 41*b* is fixed to a sticking surface 41*c* of the belt guide member 41. With the polymer polyethylene sheet 41*b* covering the elastic layer 41*a*, the other end of the sheet 41*b* is free. The polymer polyethylene sheet 41*b* can be swung around the fixed end. In the present exemplary embodiment, secondary transfer is carried out with the polymer polyethylene sheet 41*b* in contact with the back surface (inner surface) of the secondary transfer belt 31 (the polymer polyethylene sheet 41*b* can be swung with respect to the back surface).

Figure 13:
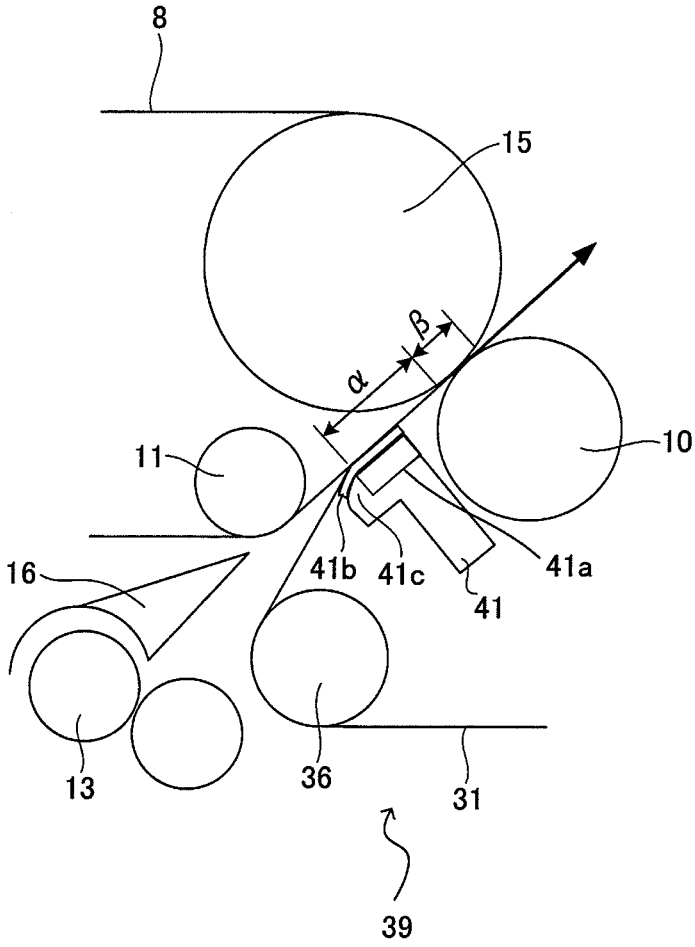
FIG. 13 schematically illustrates the configuration of a secondary transfer unit according to Exemplary Embodiment 2.

FIG. 13 schematically illustrates the configuration of the secondary transfer unit 39 according to the present exemplary embodiment. The belt guide member 41 is fixedly arranged so as to locate the fixed end of the polymer polyethylene sheet 41*b* upstream of the secondary transfer belt 31 in the moving direction thereof. In this configuration, with the secondary transfer belt 31 raised, from the back surface thereof, by the polymer polyethylene sheet 41*b* covering the surface of the elastic layer 41*a* (with the secondary transfer belt 31 pushed toward the intermediate transfer belt 8 by the polymer polyethylene sheet 41*b*), only the polymer polyethylene sheet 41*b* contacts the back surface of the secondary transfer belt 31.

This configuration enables the amount of protrusion of the belt guide member 41 toward the intermediate transfer belt 8 to be adjusted to the appropriate value. In the present exemplary embodiment, the secondary transfer belt 31 is pushed in from the back surface thereof toward the intermediate transfer belt 8 by a predetermined amount by means of the polymer polyethylene sheet 41*b* provided so as to cover the elastic layer 41*a* of the belt guide member 41 and which can be swung. Hence, even if the mounting position of the belt guide member 41 with respect to the intermediate transfer belt 8 is slightly displaced, the polymer polyethylene sheet 41*b* can come reliably into abutting contact with the back surface of the secondary transfer belt 31 and push in the secondary transfer belt 31 owing to the elasticity of the sheet 41*b*. Thus, the amount of protrusion toward the intermediate transfer belt 8 can be set to the appropriate value without the need for precise positioning.

Furthermore, even when the belt guide member 41 is mounted by being pushed in toward the intermediate transfer belt 8 with the polymer polyethylene sheet 41*b* in contact with the elastic layer 41*a*, the elastic layer 41*a* is compressed to allow the conveyance direction of the transfer material P to be set the same for both the "second area α" and the "first area β". Hence, without the need for precise positioning of the belt guide member 41, the leading end of the transfer material can be restrained from scraping off the leading end of the toner image before the transfer material enters the transfer nip portion, with the toner image restrained from spattering upstream of the transfer nip portion.

Furthermore, the polymer polyethylene sheet 41*b*, which is a low-friction member, is used, and the polymer polyethylene sheet 41*b* and the secondary transfer belt 31 slide with respect to each other. Thus, the secondary transfer belt 31 can be restrained from being worn over time.

Other Exemplary Embodiments

In the first and second exemplary embodiments, the full-color image forming apparatus with the photosensitive drums (2*a*, 2*b*, 2*c*, 2*d*) provided for the respective toner colors has been described. However, the present invention is also applicable to black-and-white image forming apparatuses and can still exert effects similar to those described above.

In Exemplary Embodiments 1 and 2, the configuration in which the secondary transfer belt 31 is cleaned by the cleaning blade 34 has been described. However, the cleaning unit is not limited to this configuration. The following cleaning unit may also be used: physical cleaning units such as a brush and a web, or electrostatic cleaning units bringing a cleaning roller which can apply a voltage to the secondary transfer belt 31, into contact with the secondary transfer belt 31 to recover toner.

In Exemplary Embodiments 1 and 2, the intermediate-transfer image forming apparatus has been described which adopts the secondary transfer belt 31 as the "transfer material bearing belt" and the intermediate transfer belt 8 as the "image bearing belt". However, the present invention is applicable to a "direct-transfer" image forming apparatus which directly transfers a toner image from a photosensitive belt to a transfer material. That is, the following scheme may be used: a conveyance belt is used as a "transfer material bearing belt", a photosensitive belt is used as the "image bearing belt, and a toner image formed on the photosensitive belt is transferred to a transfer material borne on the conveyance belt.

In this case, effects similar to those described above can be exerted by providing the above-described belt guide member inside the conveyance belt, allowing the nip portion between the photosensitive belt and the conveyance belt to serve as the transfer nip portion, and suitably setting a conveyance path for the transfer material as described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-093349, filed Apr. 14, 2010, which is hereby incorporated by reference herein in its entirety.

What is claimed is:

1. An image forming apparatus, comprising:

an endless and movable image bearing belt that bears a toner image;

an endless and movable transfer material bearing belt that bears and conveys transfer material;

a transfer member arranged on an inner surface side of the transfer material bearing belt to transfer the toner image from said image bearing belt to the transfer material borne on the transfer material bearing belt;

an opposing member configured to supply a tension to the image bearing belt, the opposing member nipping the image bearing belt and the transfer material bearing belt together with the transfer member; and a first guide member which guides movement of the transfer material bearing belt and brings the transfer material bearing belt and the image bearing belt into contact, the first guide member being provided on the inner surface side of the transfer material bearing belt and upstream of the transfer member in a moving direction of the transfer material bearing belt, wherein the first guide member includes a surface slidable on the inner surface side of the transfer material bearing belt, wherein a nip area formed by the opposing member and the transfer member is substantially parallel to a contact area in which the first guide member brings the transfer material bearing belt and the image bearing belt into contact with each other in a conveyance direction of the transfer material.

2. An image forming apparatus according to claim 1, further comprising a second guide member which guides the conveyance direction of a leading end of the transfer material to a downstream side of the contact area in the conveyance direction of the transfer material, wherein the second guide member guides the transfer material so that the leading end of the transfer material first comes into contact with the transfer material bearing belt.

3. An image forming apparatus according to claim 1, wherein a portion of the first guide member which contacts the transfer material bearing belt is positioned in a manner in which transfer material bearing belt protrudes toward the image bearing belt in the contact area.

4. An image forming apparatus according to claim 3, wherein an amount by which the first guide member protrudes toward the image bearing belt in the contact area is greater than 0 mm and equal to or less than 1 mm.

5. An image forming apparatus according to claim 1, wherein the first guide member is formed of a fluoride resin.

6. An image forming apparatus according to claim 1, wherein the first guide member comprises a surface coated with a fluorinated compound, and the surface coated with the fluorinated compound contacts the inner surface side of the transfer material bearing belt.

7. An image forming apparatus according to claim 1, wherein the first guide member comprises a polymer polyethylene sheet, and the polymer polyethylene sheet contacts the inner surface side of the transfer material bearing belt.

8. An image forming apparatus according to claim 1, wherein the first guide member comprises a polymer polyethylene sheet and an elastic layer, and the polymer polyethylene sheet is supported by the first guide member so as to cover the elastic layer in the moving direction of the transfer material bearing belt.

9. An image forming apparatus according to claim 8, wherein one end of the polymer polyethylene sheet is fixed and the other end of the polymer polyethylene sheet is free in such a manner that the polymer polyethylene sheet covers the elastic layer in the moving direction of the transfer material bearing belt.

10. An image forming apparatus according to claim 1, further comprising:

a first tension member configured to supply a tension to said transfer material bearing belt member;

a second tension member configured to supply a tension to said transfer material bearing belt member, wherein said second tension member is arranged downstream of the first tension member in a moving direction of the transfer material bearing belt, wherein the transfer member is provided between the first tension member and the second tension member in the moving direction of the transfer material bearing belt.

11. An image forming apparatus according to claim 1, wherein the first guide member is fixed so that a surface thereof keeps contacting the inner surface side of the transfer material bearing belt.

* * * * *